US007264089B2

(12) United States Patent
Sergi

(10) Patent No.: US 7,264,089 B2
(45) Date of Patent: Sep. 4, 2007

(54) SWING LOCK MECHANISM

(75) Inventor: Michael Sergi, Commack, NY (US)

(73) Assignee: Steven G. Legum, Lawrence, NY (US)

( * ) Notice: Subject to any disclaimer, the term of this patent is extended or adjusted under 35 U.S.C. 154(b) by 0 days.

(21) Appl. No.: 11/188,182

(22) Filed: Jul. 22, 2005

(65) Prior Publication Data

US 2006/0175145 A1 Aug. 10, 2006

Related U.S. Application Data

(60) Provisional application No. 60/590,592, filed on Jul. 23, 2004.

(51) Int. Cl.
*B66B 13/06* (2006.01)
*E06B 1/00* (2006.01)

(52) U.S. Cl. ..... 187/333; 187/331; 187/335; 49/380; 49/425; 206/325; 16/86.1

(58) Field of Classification Search ..... 187/333, 187/335, 331; 16/86.1, 86.2; 292/56, 121
See application file for complete search history.

(56) References Cited

U.S. PATENT DOCUMENTS 3,654,734 A * 4/1972 Lehman ..... 49/505
4,153,234 A * 5/1979 Sherwood et al. ..... 256/69
4,299,058 A * 11/1981 Spaulding ..... 49/386
4,420,905 A * 12/1983 Kucharczyk ..... 49/192
4,949,772 A * 8/1990 Ballyns et al. ..... 160/201
5,515,876 A * 5/1996 Warner et al. ..... 134/57 D
5,519,920 A * 5/1996 Runge et al. ..... 16/367
5,673,770 A 10/1997 Friedman
5,887,681 A * 3/1999 Bondavalli ..... 187/333
6,202,798 B1 3/2001 Friedman et al.
6,223,661 B1 * 5/2001 Griepentrog ..... 108/169
6,286,692 B1 * 9/2001 Hemping ..... 211/169
6,511,120 B1 * 1/2003 Mitts ..... 296/202
6,659,514 B2 * 12/2003 Bass ..... 292/122
6,684,570 B1 * 2/2004 Robledo ..... 49/394
6,715,182 B2 * 4/2004 Cheng ..... 16/280
6,997,504 B1 * 2/2006 Lang et al. ..... 296/146.11
7,021,005 B1 * 4/2006 Curry ..... 49/358
2002/0095971 A1 * 7/2002 Pawson ..... 72/457
2002/0112320 A1 * 8/2002 Hayashi ..... 16/386
2003/0070768 A1 * 4/2003 Lewis et al. ..... 160/92

* cited by examiner

*Primary Examiner*—Gene O. Crawford
*Assistant Examiner*—Terrell Matthews
(74) *Attorney, Agent, or Firm*—Baker Botts LLP

(57) ABSTRACT

A system and method for installing an elevator door hatchway opening. The system comprises a steel square comprising a top piece, a bottom piece and left and right jambs, a door buck that is bolted to the steel square and at least one exterior hatchway door that is installed on a center portion of the steel square. The steel square is attached by at least one swing lock hinge to at least one elevator shaft way bracket while the steel square is angled outside of an elevator shaft way.

16 Claims, 3 Drawing Sheets

SWING LOCK MECHANISM

CROSS REFERENCE TO RELATED APPLICATIONS

This application claims priority based on U.S. Provisional Patent Application entitled "SWING LOCK MECHANISM," Ser. No. 60/590,592, which was filed on Jul. 23, 2004.

BACKGROUND OF THE INVENTION

The present invention relates to the installation of an elevator door hatchway, and more particularly to a method and apparatus for installing the parts of an elevator door hatchway.

The Related Art

Elevator installation normally includes the setting up of the carriage (which is the elevator car), the elevator shaft, the rails and the door hatchway opening. Normally, the hatchway opening installation process is performed by using what is commonly referred to in the industry as a "running platform." This is the carriage without the decorative cab portion. In order to install the components of the hatchway opening, the workmen must be inside the shaft area by standing within the previously installed running platform. The steel square along with the door buck, which is the frame outside of the hatchway entrance, is hoisted inside the shaft area only when the carriage is at the same level with the door opening. Without the carriage, workmen installing the hatchway opening would have to attempt to work within an open shaft way at great peril.

The use of the carriage causes a delay in the total elevator installation process because the "running platform" must be "borrowed" from the remainder of the job. Workmen, from other parts of the elevator construction job site, who would need the same running platform for other installation processes, i.e. shaft work, cab decoration etc., normally pause for two week periods, if not more, for each door hatchway installation while the hatchway opening work is completed. A typical high-rise building can have 400 to 800 openings for which the delays in the installation procedure result in extra construction costs and longer total building completion times.

SUMMARY OF THE INVENTION

It is an object of the invention to overcome the foregoing and other disadvantages of the prior art by providing a method and apparatus for installing the parts of the elevator door hatchway without the necessity of the use of a running platform (carriage). This is considerably faster, more efficient and, most importantly, a safer process for the workmen. The workmen can complete the installation process at the open shaft way, without entering the shaft way itself and without the use of the running platform (carriage).

BRIEF DESCRIPTION OF THE DRAWINGS

For a more complete understanding of the present invention, and the advantages thereof, reference may be made to the following description of exemplary embodiments thereof, taken in conjunction with the accompanying drawings in which.

DETAILED DESCRIPTION OF EXEMPLARY EMBODIMENTS

Figure 1:
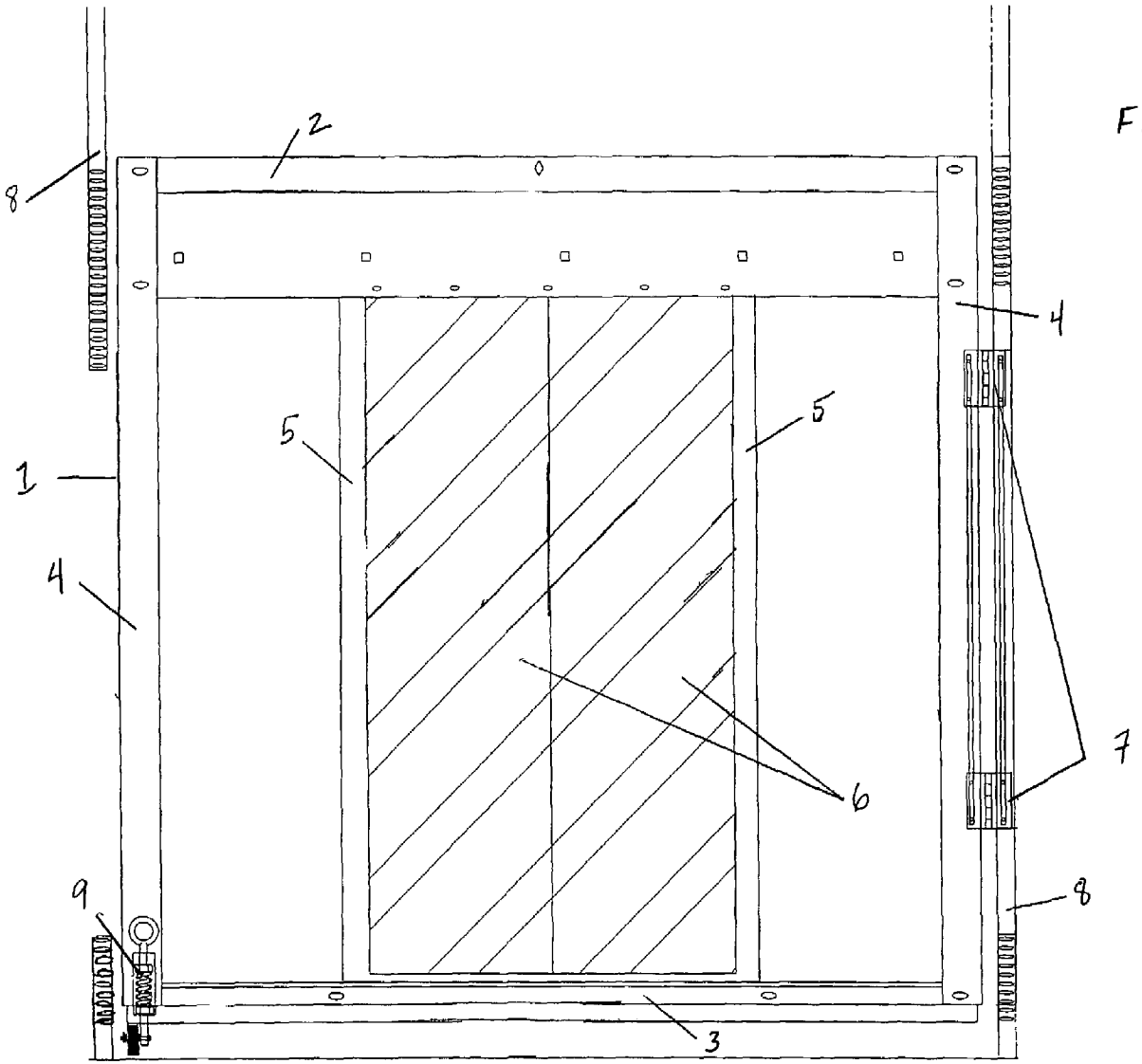
FIG. 1 is a front view of an embodiment of a swing lock method and apparatus in accordance with the invention.

In accordance with one embodiment of the invention, as shown in FIG. 1, a steel square, or sub-frame, comprises a header (top piece), a sill 3 (the bottom piece), and left and right jambs 4 (vertical pieces). The door buck 5 is an exterior metal finished frame in the hallway at the shaft opening. The door buck 5 is bolted to the steel square 1. The exterior hatchway doors 6 are installed on the center of the square 1. The steel square 1, which now includes the door buck 5, and doors 6, is then attached by a swing lock hinge 7, shown in FIGS. 1 and 2, to shaft way brackets 8.

In one exemplary embodiment, a weight support may also be used. The weight support may be in the form of a safety weight wheel 9. It may also be a suspensory cable.

Figure 2:
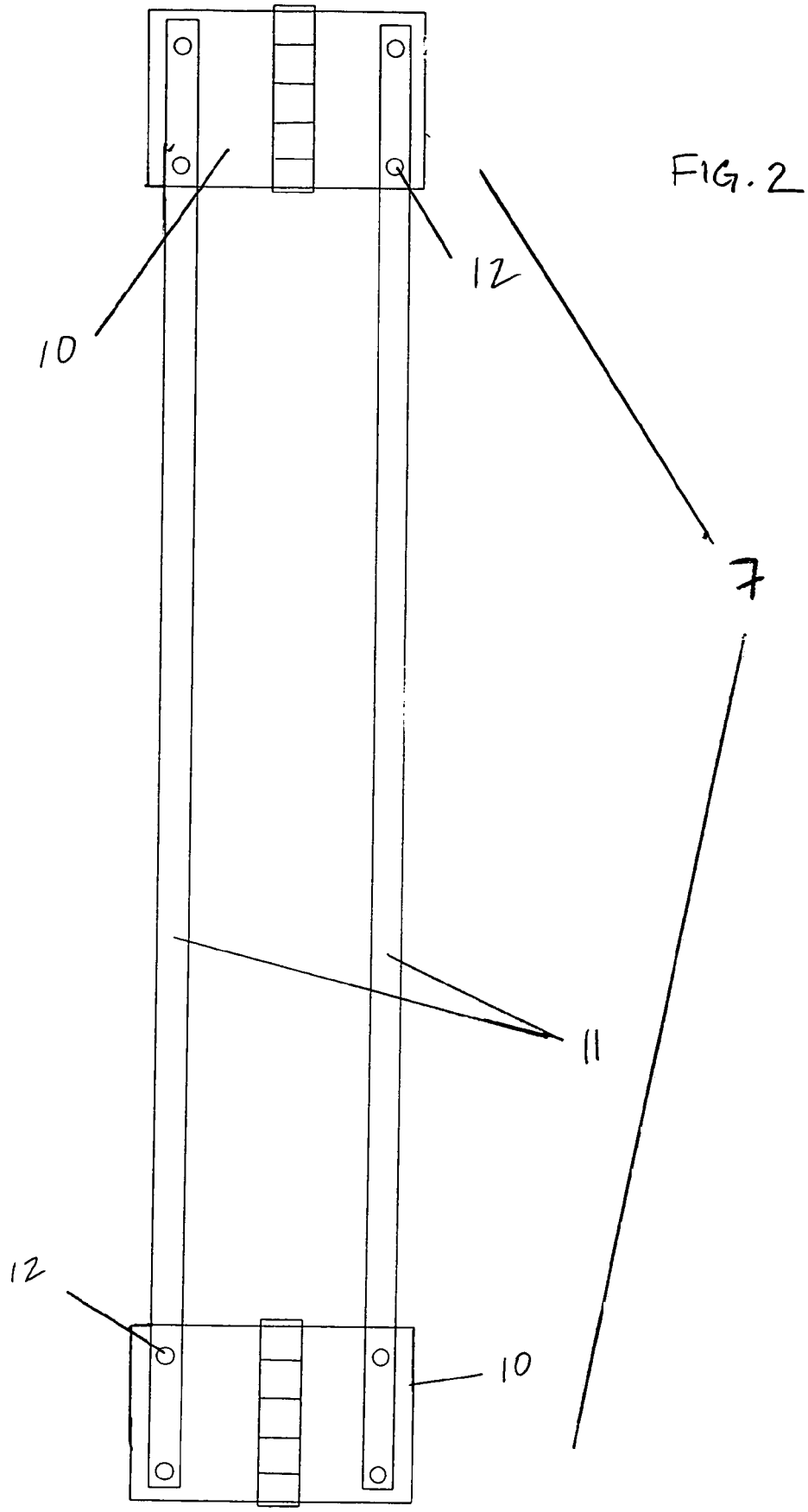
FIG. 2 is a front view of an embodiment of a swing lock hinge in accordance with the invention.
Figure 3:
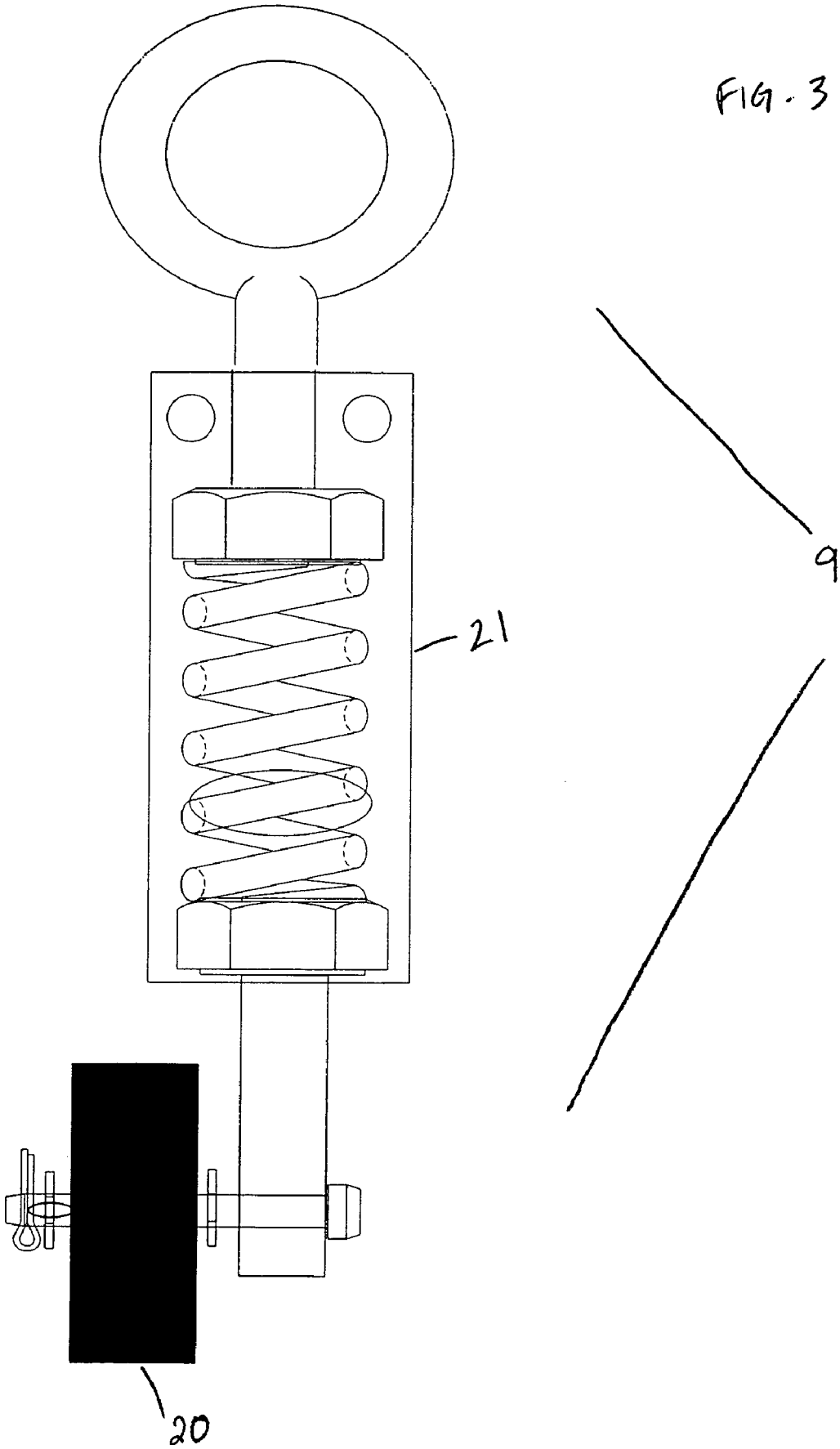
FIG. 3 is a front view of an embodiment of a swing wheel in accordance with the invention.

A safety weight wheel 9, one exemplary embodiment of which is shown in FIGS. 1-3, is attached to the sill side of the steel square 3 which is opposite to the swing lock hinge 7. The steel square structure is attached to the shaft way brackets 8 while the entire steel square structure is angled approximately 90 degrees into the hallway (of the building) and outside of the shaft way.

One exemplary embodiment of the swing lock hinge 7 is shown in FIG. 2. The swing lock hinge 7 comprises stainless steel hinge plates 10, stainless steel tubes 11, and whiz nuts and bolts 12. The dimensions of the hinge plates 10 are 6" wide×8" tall×¼" thick. The tubes 11 are 2" wide×55" tall×2" thick. The swing lock hinge 7 is attached to the shaft way brackets 8 with whiz nuts and bolts 12. The swing lock hinge 7 is rated for 1000 pounds of weight bearing.

One embodiment of the safety weight wheel 9 is shown in FIGS. 1 and 3. The safety weight wheel includes a wheel 20 and weight bearing portion 21.

Once the swing lock hinge 7 is attached to the shaft way brackets 8, the steel square with the attached door buck 5 and doors 6 is then swung into the frame of the open shaft way with the use of the safety weight wheel 9, and then bolted in place. The safety weight wheel 9 and swing lock hinge 7 are then removed to be re-used on future openings. Workmen do not have to enter the shaft way, nor is there the risk of dropping the door buck down the shaft.

The time for mounting the steel square to the door buck and doors, and attaching same to the shaft way brackets with this system, can take approximately two hours as opposed to the usual two week period (which includes down time resulting from waiting to schedule the use of the running platform). The above-described embodiments are intended to be only exemplary and are susceptible to variations and modifications that are intended to be included within the scope of the invention.

The invention claimed is:

1. A system for installing an elevator door hatchway opening comprising:

a steel square comprising a top piece, a bottom piece and left and right jambs;

a door buck that is attached to said steel square; and at least one exterior hatchway door that is installed on a center portion of said steel square, said steel square being attached by at least one swing lock hinge to at least one elevator shaft way bracket while said steel square is angled outside of an elevator shaft way.

2. The system of claim 1 wherein a weight support is attached to said steel square to support at least partially said steel square and door buck.

3. The system of claim 2 wherein said steel square is swung into a frame of said shaft way with the use of said weight support and can be bolted into place and wherein said at least one swing lock hinge and said weight support are removable and reusable.

4. The system of claim 2 wherein said weight support is a safety weight wheel.

5. The system of claim 1 wherein said at least one swing lock hinge comprises a stainless steel hinge plate, two stainless steel tubes and whiz bolts and nuts.

6. The system of claim 1 wherein said at least one swing lock hinge is attached to said at least one elevator shaft way bracket with whiz bolts and nuts.

7. system of claim 1 wherein said at least one swing lock hinge is rated for at least 1000 pounds of weight bearing.

8. system of claim 1 wherein said door buck is attached to said steel square by at least one bolt.

9. A method for installing an elevator door hatchway opening comprising:

bolting a door buck to a steel square, said steel square comprising a top piece, a bottom piece and left and right jambs;

installing at least one exterior hatchway door on a center portion of said steel square; and attaching said steel square by at least one swing lock hinge to at least one elevator shaft way bracket while said steel square is angled outside of an elevator shaft way.

10. The method of claim 9 wherein a weight support is attached to said steel square to support at least partially said steel square and door buck.

11. The method of claim 10 wherein said steel square is swung into a frame of said shaft way with the use of said safety weight wheel and can be bolted into place and wherein said at least one swing lock hinge and said safety weight wheel are removable and reusable.

12. The method of claim 10 wherein said weight support is a safety weight wheel.

13. The method of claim 9 wherein said at least one swing lock hinge comprises a stainless steel hinge plate, two stainless steel tubes and whiz bolts and nuts.

14. The method of claim 9 wherein said at least one swing lock hinge is attached to said at least one elevator shaft way bracket with whiz bolts and nuts.

15. The method of claim 9 wherein said at least one swing lock hinge is rated for at least 1000 pounds of weight bearing.

16. The method of claim 9 said door buck is attached to said steel square by at least one bolt.

* * * * *